US006324466B1

(12) United States Patent
Vieweg et al.

(10) Patent No.: US 6,324,466 B1
(45) Date of Patent: Nov. 27, 2001

(54) METHOD AND TERMINAL UNIT FOR THE SPATIAL ALLOCATION OF INFORMATION REFERRING TO ONE LOCATION

(75) Inventors: Stefan Vieweg; Josef Heimann, both of Düsseldorf; Werner Schulz, Meerbusch, all of (DE)

(73) Assignee: Mannesmann AG, Düsseldorf (DE)

( * ) Notice: Subject to any disclaimer, the term of this patent is extended or adjusted under 35 U.S.C. 154(b) by 0 days.

(21) Appl. No.: 09/319,099

(22) PCT Filed: Nov. 27, 1997

(86) PCT No.: PCT/DE97/02820

§ 371 Date: May 28, 1999

§ 102(e) Date: May 28, 1999

(87) PCT Pub. No.: WO98/24079

PCT Pub. Date: Jun. 4, 1998

(30) Foreign Application Priority Data

Nov. 28, 1996 (DE) ..... 196 51 013
Nov. 6, 1997 (DE) ..... 197 50 786

(51) Int. Cl.[7] ..... G08G 1/09

(52) U.S. Cl. ..... 701/117; 340/934; 340/910; 340/990; 701/208; 701/209; 701/211; 345/353; 345/357; 345/333; 395/352; 395/353

(58) Field of Search ..... 701/117, 209, 701/208, 211; 340/905, 995; 345/353

(56) References Cited

U.S. PATENT DOCUMENTS 5,182,555 * 1/1993 Sumner ..... 340/905
5,187,810 * 2/1993 Yoneyama et al. ..... 455/34.1
5,504,482 * 4/1996 Schreder ..... 340/995
5,539,398 * 7/1996 Hall et al. ..... 340/907
5,784,059 * 7/1998 Morimoto et al. ..... 345/353
5,862,510 * 1/1999 Saga et al. ..... 701/211
5,899,953 * 5/1999 Urahashi ..... 701/117
5,948,042 * 9/1999 Heimanne et al. ..... 701/208

* cited by examiner

*Primary Examiner*—William A. Cuchlinski, Jr.
*Assistant Examiner*—Tuan C To
(74) *Attorney, Agent, or Firm*—Cohen, Pontani, Lieberman & Pavane

(57) ABSTRACT

An efficient and trouble-proof location referencing of information transmitted from a information provider to the terminal unit is made possible by a method for spatial allocation of information, referring to a location in a terminal unit, wherein the information is sent from an information provider (6) to the terminal unit together with location coordinate data which is associated with this information and which concerns the geographic coordinates (geographic longitude and latitude) of the location and with supplemental location data the allocation of the information to a location is carried out in the terminal unit:

based on a comparison of the transmitted location coordinate data relating to the information with location coordinate data in a reference file in the terminal unit;

and based on a comparison of the transmitted supplemental location data relating to the information (1, 2) with supplemental location data (4, 5) in the reference file (10) in the terminal unit (8), and by means of a terminal unit.

39 Claims, 3 Drawing Sheets

METHOD AND TERMINAL UNIT FOR THE SPATIAL ALLOCATION OF INFORMATION REFERRING TO ONE LOCATION

BACKGROUND OF THE INVENTION

1. Field of the Invention

The invention is directed to a method for spatial allocation of information referring to a location and is directed to a terminal unit for carrying out the method.

2. Discussion of the Prior Art

For automatic evaluation of location-oriented information, for example, traffic information, determination of the location to which the information refers and a match with the location at which the terminal unit is located is required in the terminal unit receiving this information. A problem in this respect is that the geographic positions of locations are generally determined neither precisely, nor definitively because, for example, locations such as street intersections, forks or branch-offs, etc. are assigned different positions on different maps, and when updating maps, etc. the geographic positions of locations in the map sometimes change or new locations such as new branch-offs are added.

A possible method for spatial allocation in a terminal unit of information referring to a location would be to issue a standardized identification number to important locations such as stretches of road, highway exits, etc., wherein the information provider and the terminal unit both have identical tables of identification numbers and associated locations. While this method is definitive, it cannot be updated continuously without elaborate centralized administrative management. Further, because of the abstract issuing of identity numbers, in the case of an old table of codes in the terminal unit, a spatial allocation of information received by an information provider is not possible at least in the case of a new location, such as a new highway exit, designated by a new identity number.

In another conceivable method, names can be assigned to the locations. In this case, long roads, especially highways, must be divided up through additions such as "between junction x and y". With respect to an automatic evaluation of information sent from an information provider to a terminal unit, problems can arise due to different types of writing, for example, umlauts and abbreviations, as well as different designations, for example, Stachus and Karlsplatz in Munich, and the nonstandardized naming of exits, etc. by the locality adjoining the exit.

Further, allocation of a location through geographic coordinates such as the geographic longitude and latitude of a location is also possible. However, the problem in this case is that the same location, for example, a street intersection, is located in different positions on different maps, which causes problems when the traffic information center receives data referring to different maps or when the geographic coordinates of a location in the map change due to an update of the map. Even in the case of relatively minor inaccuracies in the indication of geographic coordinates on a map, this location can no longer be definitively allocated in a terminal unit. However, a definitive allocation of locations to standardized geographic coordinates would entail highly complicated administration for definition and upkeep.

SUMMARY OF THE INVENTION

It is the object of the invention to provide an efficient method for spatially allocating, in a terminal unit, information which refers to a location and which is sent from an information provider to the terminal unit.

Transmitted geographic coordinates of the location to which information refers, which geographic coordinates are represented by location coordinate data, can be represented, for example, in the form of two-dimensional coordinates, especially as the geographic longitude and latitude of the location. Location characteristics of the location which are designated as supplemental location data can include, in particular, the road type and road number of the location. Further, they can include one or more names of the location. Moreover, they can include additional attributes of the location such as information on whether or not it is situated at an intersection, fork, etc., on what roadway, and whether it is situated at the end, beginning or in the middle of the roadway, etc.

If location coordinate data transmitted along with information sent from an information provider to a terminal unit are contained in a reference file in the terminal unit, the location is defined for the terminal unit. Based on the additional location file, particularly the road type and road number, a plausibility check can also be carried out. The location can be further processed and/or read out based on the location coordinate data or on further data stored in the reference file on these location coordinate data. However, when the transmitted location coordinate data of the location are not contained in the reference file in the terminal unit and also, as the case may be, if the supplemental location data supplementing the location coordinate data in the reference file do not match the transmitted supplemental location data, the location to which the information of the information provider refers can be established on the basis of the supplemental location data transmitted along with this information and its location coordinate data by searching for these supplemental location data in the reference file of the terminal unit. The additional use of supplemental location data accordingly increases the probability of correct spatial allocation of received information about a location in the terminal device and also avoids errors when, for example, owing to updated maps or use of different maps than those used previously, the geographic coordinates of a determined location according to the updated or different maps change in the case of the information provider or deviate in the case of a different information provider, while only location coordinates for one particular map version are contained in the terminal unit.

The spatial allocation of information received in a terminal unit about the location to which the information refers can be optimized by the type of location coordinate data and supplemental location data transmitted with information from an information provider to the terminal unit.

In particular, as was stated above, supplemental location data can include the road type and road number of the location to which the received information refers and/or the names of these locations; the supplemental location data further advisably have attributes of the location such as the information about whether there is an intersection or branch-off, the roadway to which it refers, the start, end or middle of the roadway, etc.

The location coordinate data identify the location to which the information refers, advisably by means of an identification number which represents the geographic coordinates of the location. The location coordinate data are very compact when the geographic coordinates of the location are rounded off at 10 to 500 m, especially 100 m, that is, by adopting only the higher-value digits (values starting from 100 m) of the longitude and latitude in the location coordinate data (GeoCode location coordinate file); the lower-value digits of the location coordinates in which errors frequently occur because of different maps and which do not significantly simplify the spatial allocation are ignored.

The information, location coordinate data and supplemental location data are advisably transmitted in a predetermined format and/or in a predetermined sequence, preferably both, from the information provider to the terminal unit, which facilitates automatic processing in the terminal unit.

Particularly when there are several usual standardized map files, an identification of the digital map of a traffic network to which the location coordinate data refer is advantageous because the location can be identified more easily based on the digital map in the terminal unit associated with these location coordinates.

The method can be used for the transmission and spatial allocation of different information. In particular, information can be traffic information of a traffic information provider for a terminal unit which can be arranged in a vehicle. In addition to pure traffic information, for example, on backups, travel times, average speeds, etc., the method can also be used in particular for interactive navigation in which a definitive identification of a location concerning navigation information, for example, the current location of the vehicle, is significant.

The transmission of information from the information provider to the terminal unit can be carried out in different ways. In particular, it is possible to transmit the information in coded or unencoded form via radio, mobile radio, paging, etc.

The information is advisably read out to a user of the terminal unit. The information can be further processed for this purpose. Accordingly, a report can be generated for the user based on location coordinate data and/or supplemental location data, possibly with further transmitted data or data taken from the reference file. If the user knows the location of the terminal unit, it is possible in particular to filter the information, e.g., with respect to local relevance for the user, wherein only relevant data are read out to the user of the terminal unit. Further, when the position of the terminal unit is known, for example, from GPS and/or based on the tracking of the position of the terminal unit in a map taking into account the speed and steering wheel position, etc., it is possible to link the location with the received information; for example, the report "backup on A3 between junctions x and y" can be transformed to "backup two kilometers ahead, length of 30 km".

Moreover, it is possible to correct the reference file in the terminal unit and/or on the part of the information provider in case of discrepancies between the transmitted location coordinate data of a location and location coordinate data established on the basis of the supplemental location data in the reference file that were transmitted along with it by erasing the location coordinate data stored in the reference file. In this connection, it is possible to load an updated reference file from the information provider to the terminal unit via mobile radio, etc. Further, an individual correction of the specific location is also possible; for example, the location coordinate data sent from the information provider to the terminal unit about a location can be stored in the reference file of the terminal unit as location coordinate data of the location which is defined by the supplemental location data corresponding to the supplemental location data that were transmitted along with them.

A terminal unit according to the invention has, in particular, a reference file with at least one allocation of location coordinate data to supplemental location data.

Further features and advantages follow from the additional subclaims and the description of an embodiment example with reference to the drawing.

DETAILED DESCRIPTION OF THE PREFERRED EMBODIMENTS

Figure 1:
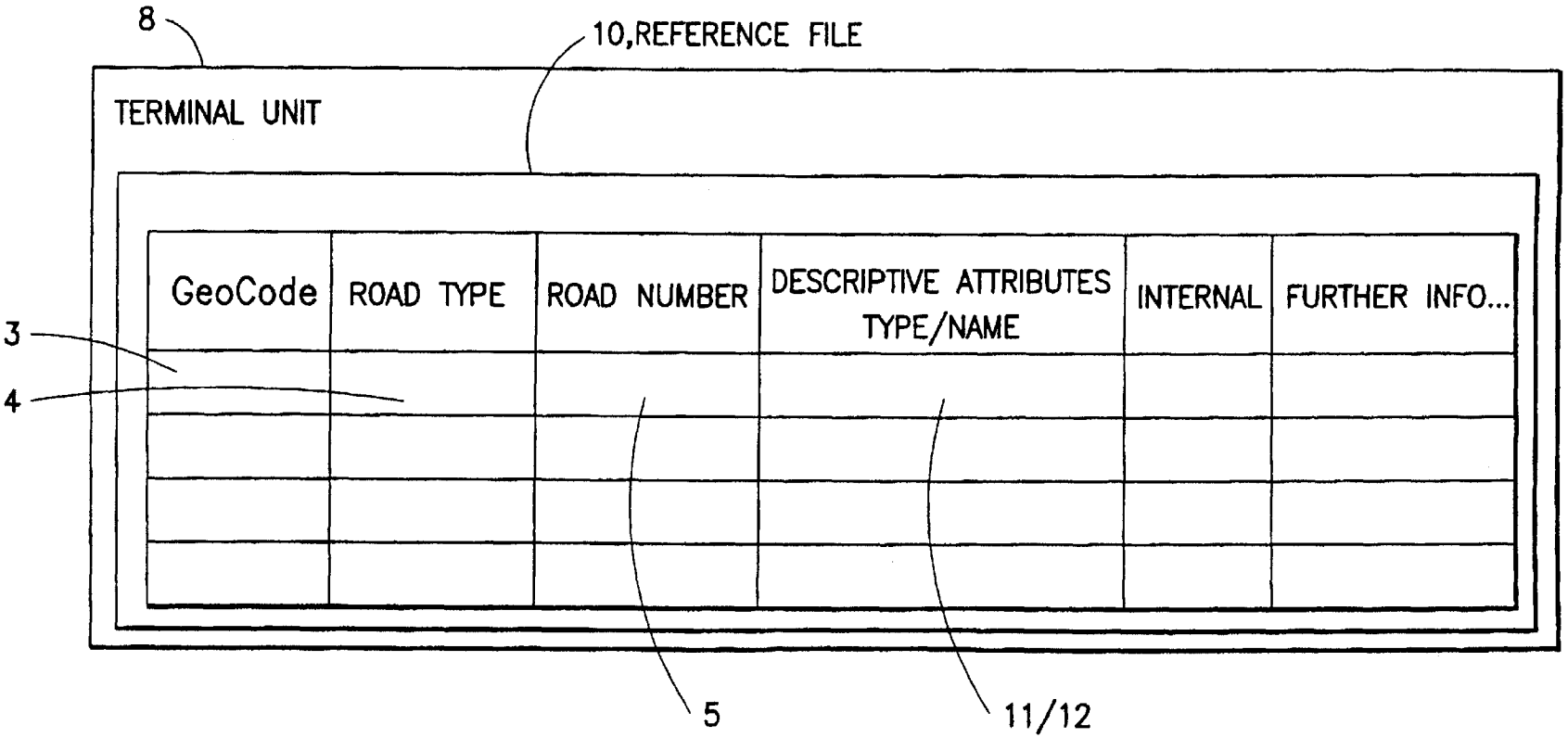
FIG. 1 shows in abstract form the composition of a reference file present in the terminal unit and advisably also for the information provider.
Figure 2:
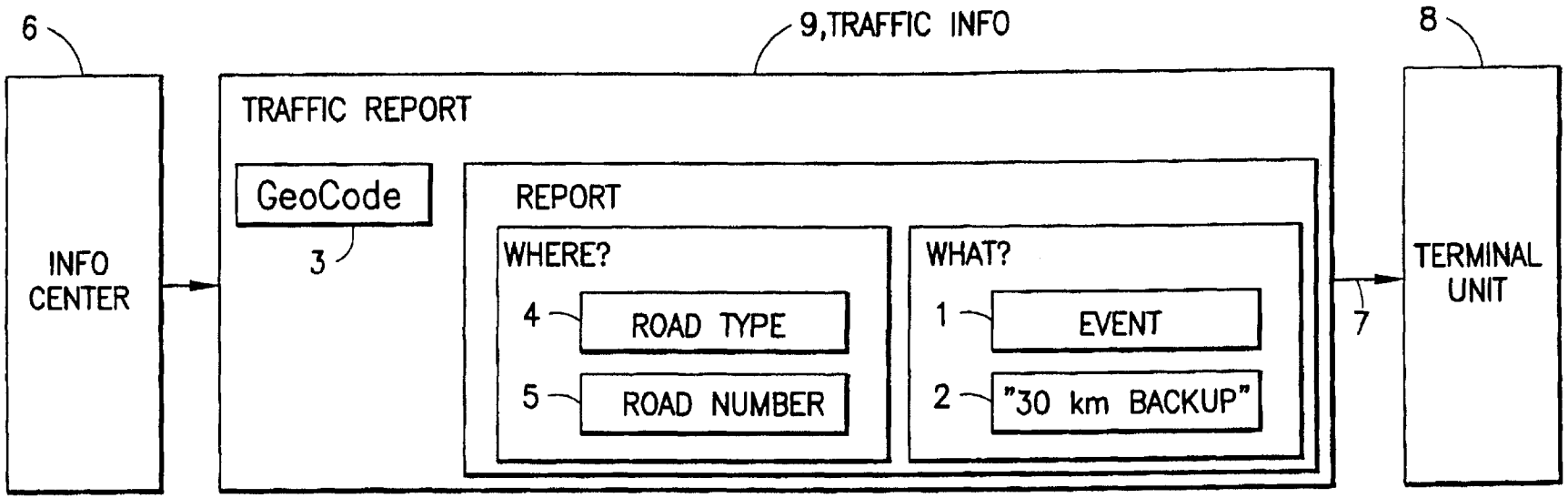
FIG. 2 shows the composition of a traffic report.
Figure 3:
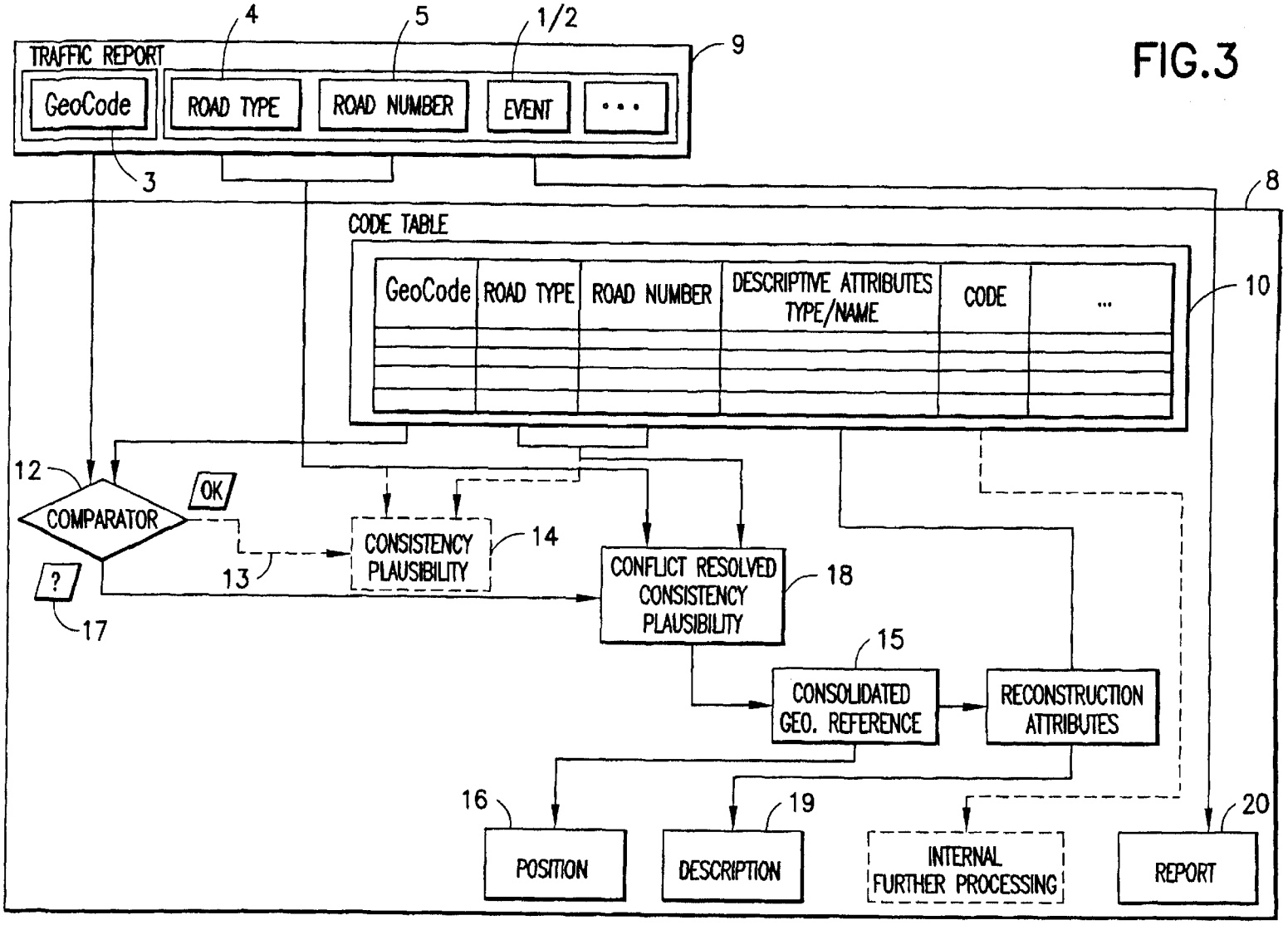
FIG. 3 shows a schematic view of the spatial allocation of information received in the terminal unit to a location, taking into account a reference file in the terminal unit.

Taking into account the reference file of the terminal unit, which reference file is shown schematically in FIG. 1, information which is shown in FIG. 2 and transmitted along with location coordinate data and supplemental location data is spatially allocated according to the method shown in abstract form in FIG. 3.

A traffic report shown by way of example in FIG. 2 includes, in addition to the information (1, 2) represented as "event" (1) and "30 km backup" (2), location coordinate data 3 and supplemental location data 4, 5 designated as GeoCode.

A report of the kind mentioned above is transmitted from an information provider such as a traffic information center 6 to a terminal unit 8 by mobile radio, paging, radio, etc. 7.

In the terminal unit 8, the traffic information 9 is spatially allocated, based on a reference file 10 shown in FIG. 1, to the location to which the information 1, 2 refers. The location coordinate data 3 designated as GeoCode can be used in particular for this purpose. These location coordinate data 3 are formed in this case by rounding off and omitting the lower-value digits to roughly 100 m accuracy from the geographic longitude 12°34'99" and latitude 56°78'99" of the location to which the information refers (that is, e.g., 12345678). Therefore, even when it is not possible to allocate transmitted information to a location due to the absence of location coordinates sent in relation to it and in the absence of supplemental location data in the reference file 10 of the terminal unit 8, an at least approximate spatial allocation of the information 1, 2 to a location is possible based on the geographic longitude and latitude (12°34' W and 56°78' N) implied in the GeoCode (e.g., '12345678'= location coordinate data). In the simplest case, the location coordinate data 3 of the traffic report can be found in the reference file in the terminal unit 8. The supplemental location data 4, 5 of the traffic report are then compared with supplemental location data 4, 5 in the reference file 10 in the terminal unit 8 as well as other attributes (such as "intersection", "Karlsplatz"), as the case may be. In the event that the supplemental location data 4, 5 and, where applicable, also the attributes 11, 12 among the transmitted location coordinate data 3 in the reference file 10 in the terminal unit 8 match that transmitted, the location to which the information 1, 2 refers is definitely determined and can be used for relevance checking of the information 1, 2 and/or readout with the information 1, 2 to the user of the terminal unit 8 and/or navigation. The relevance check can filter out, for example, only the information which is significant to the user based on his location which can be determined on the basis of route determination and/or GPS, etc. For example, it is possible to take into consideration only information about the road on which the user with the terminal unit 8 moves forward and/or roads lying in the driving direction and/or a determined spatial circumference.

However, when the supplemental location data 4, 5 under the entry in the reference file 10 for the transmitted location coordinate data 3 do not match the supplemental location data 4, 5 transmitted with these location coordinate data 3, an entry with these supplemental location data 4, 5 is searched for in the reference file 10 and its location is defined as the location to which the information 1, 2 refers. Instead of this, or in addition, attributes such as names, etc. of the location can also be used for checking if required. Further, the attributes can be used in order to supplement a report to be read out to a user of the terminal unit 8, for example, by adding a name ("Exit: Pasing") etc., of a location stored in the reference file in the terminal unit to information regarding this location.

FIG. 3 shows a run-through of the check. A traffic report 9 containing location coordinate data 3, supplemental location data and information 1, 2 and sent by an information provider to a terminal unit is further processed in the terminal unit 8. For this purpose, the location coordinate data 3 of the transmitted traffic report 9 in the terminal unit 8 is searched (12) in a reference file 10. In case an entry is found here (13), it is checked for consistency and plausibility (14) by comparing the supplemental location data 4, 5 in the received traffic report 9 and in the reference file 10 in the terminal unit 8. If the supplemental location data 4, 5 match, the location coordinate data 3 are defined as a consolidated geographic reference 15 and are considered as location 16 to which the information 1, 2 refers. However, if there is no entry (17) for the location coordinate data 3 of the traffic report 9, the location is determined based on the supplemental location data 4, 5. This can be the road type 4 (e.g., highway or "A") and the road number 5 (e.g., "8") in particular. The road type ("A") and the road number can also be sent together in one box or slot ("A8"). After this consistency check or supplementing 18, the location obtained in this way is regarded as a consolidated geographic reference (15). Based on this location, attributes such as the name ("Stachus" or "Karlsplatz" or "Exit: Pasing") which are stored in the terminal unit can be determined in relation to the obtained information 1, 2 and read out along with it to a user (as description 19). Further, information 1, 2 regarded as relevant based on the location, etc. with or without attributes can be read out to a user of the terminal unit 8.

When location coordinate data 3 and supplemental location data 4, 5 and/or possibly also attributes 11 in the traffic report 9 and in the reference file 10 do not match, this error can automatically be corrected, e.g., in the reference file 10 of the terminal unit 9 or a new reference file 10 can be loaded in the terminal unit by the information provider, for example, via mobile radio or in some other way.

The statements above serve only as examples. According to the invention, the slots for supplemental location data and/or location coordinate data can also be filled up differently. For example, a slot for a city ("Munich") can be provided alternatively or in addition to a slot (or several—in this case 4, 5) for a road, etc.

In addition to pure information, especially traffic information, the method according to the invention is also suitable in particular for navigation, since it is very important in this case to determine locations as exactly as possible with as few errors as possible.

In the terminal unit 8 which is not shown in detail in this case, the method is implemented in a program which is stored in the terminal unit. Further, a map file can be used in the method, especially for navigation methods, and can be stored in the terminal unit. A reference file can be stored in the terminal unit; a reference file can also be stored on an exchangeable storage medium such as a chip card or the like, wherein data can be read into the terminal unit from the storage by means of a reading device. A processor is provided in the terminal unit for running the program. The information of the information provider enters a reception device for radio and/or mobile radio and/or pager, etc. in the terminal unit. Information 1, 2 etc. which may possibly have been reworked or supplemented is read out to the user of the terminal unit by means of an acoustic or optical readout device, for example. Further, a back channel, especially the uplink of a mobile radio channel, can be provided in the terminal unit for error correction or for downloading a current reference file 10. The terminal unit is especially suitable for installation in a vehicle. For determining position, it can comprise, for example, a GPS receiver and/or means for determining position by means of an internal map, the steering wheel position and odometer and/or speedometer, etc.

What is claimed is:

1. A method for spatial allocation of information referring to a location in a terminal unit, comprising the steps of:

sending the information from an information provider to the terminal unit together with location coordinate data which is associated with this information and which concerns the geographic coordinates of the location and with supplemental location data;

carrying out an allocation of the information to a location in the terminal unit:

based on a comparison of the transmitted location coordinate data relating to the information with location coordinate data in a reference file in the terminal unit; and based on a comparison of the transmitted supplemental location data relating to the information with supplemental location data in the reference file in the terminal unit; and storing the location coordinate data of the location in files of the information provider and in the terminal unit and sending the data from the information provider to the terminal unit as identification of a location to which transmitted information refers, the location coordinate data exactly designating the geographic coordinates of the location to every 10 to 500 m.

2. A method according to claim 1, wherein the information is traffic information, the information provider is a traffic information provider, and the terminal unit is arranged in a vehicle.

3. A method according to claim 1, wherein the supplemental location data include road type and road number of the location to which the information refers.

4. A method according to claim 1, wherein the supplemental location data include, at least in the terminal unit, at least one of a name of a position and a city, municipality, or district.

5. A method according to claim 1, including checking supplemental location data when an entry relating to a location for the location coordinate data is found in the reference file, and determining the location on the basis of the transmitted supplemental location data by searching for the supplemental location data in the reference file when there are differences between the transmitted supplemental location data of the transmitted information and the supplemental location data in the reference file.

6. A method according to claim 1, including determining the location on the basis of a comparison of the transmitted supplemental location data with supplemental location data in the reference file when the transmitted location coordinate data are not contained in the reference file.

7. A method according to claim 1, including determining the location on the basis of the location coordinate data approximately with respect to its geographic longitude and latitude when neither the transmitted location coordinate data nor the supplemental location data are contained in the reference file.

8. A method according to claim 1, wherein the supplemental location data, at least in the terminal unit, include data representing attributes concerning at least one of presence of an intersection, a branch-off, a roadway and a start, middle and end of the roadway.

9. A method according to claim 1, wherein the location coordinate data exactly designate the geographic coordinates of the location every 100 m.

10. A method according to claim 1, wherein the sending step includes sending the information, the location coordinate data and the supplemental location information at least one of in a predetermined format and in a predetermined sequence from the information provider to the terminal unit.

11. A method according to claim 1, including correcting the reference file if a discrepancy exists between at least one of the location coordinate data and the supplemental location information received and retrieved from the reference file, respectively, by identifying the location coordinate data stored in the reference file found to have a discrepancy with the received location coordinate data, erasing the location coordinate data and associated supplemental location information from the reference file, and storing the received location coordinate data and associated supplemental location information in the reference file.

12. A method according to claim 1, including navigating a vehicle by using the information.

13. A method according to claim 1, including transmitting an identification of a digital map to which the location coordinate data refer.

14. A method according to claim 13, wherein the location in the map that is used in the terminal unit is also determined at least based on the identification.

15. A method according to claim 1, including reading out messages concerning at least one of the location coordinate data and the supplemental location data from the terminal unit in addition to the information.

16. A method according to claim 1, including generating and reading out a report based on additional information stored in the reference file, the additional information being for a set of location coordinate data of a location in the terminal unit, and at least the transmitted information from the terminal unit.

17. A method according to claim 1, wherein the information provider also has a reference file.

18. A method according to claim 17, wherein the information provider formats and orders the information, location coordinate data and supplemental location data by means of the reference file.

19. A method according to claim 1, including generating and sending to the information provider a report comprising at least one of the location coordinate data present in the terminal unit and the supplemental location data and the information when a discrepancy is determined between supplemental location data transmitted with the information and the location coordinate data and the supplemental location data determined on the basis of the transmitted location coordinate data in the reference file in the terminal unit.

20. A method according to claim 1, including requesting a current reference file from the information provider and transmitting the current reference file from the information provider to the terminal unit when a discrepancy is determined between supplemental location data transmitted in relation to location coordinate data and supplemental location data determined on the basis of the transmitted location coordinate data in the reference file in the terminal unit.

21. A method according to claim 1, wherein other location coordinate data concerning locations contained in the reference file are contained in the reference file for a set of location coordinate data, a readout of the terminal unit to a user of the terminal unit being based on these locations.

22. A method according to claim 1, wherein the sending of information from the information provider to the terminal unit is carried out via one of a radio channel, a mobile radio network, and a paging network.

23. A method according to claim 1, including carrying out a determination of location in the terminal unit and using the location of the terminal unit for relevance checking of the information, and reading out only relevant information to a user of the terminal unit.

24. A method according to claim 1, including linking the location of the terminal unit known to the terminal unit with information received from the information provider in a report to be read out to a user of the terminal unit.

25. A method according to claim 1, wherein the reference file is on an exchangeable storage medium.

26. A method according to claim 25, wherein the reference file is on one of a chip and a CD ROM.

27. A terminal unit comprising:

a reference file and a program for carrying out a method for spatial allocation of information, which method includes the steps of sending the information from an information provider to the terminal unit together with location coordinate data which is associated with this information and which concerns the geographic coordinates of the location and with supplemental location data; carrying out an allocation of the information to a location in the terminal unit, based on a comparison of the transmitted location coordinate data relating to the information with location coordinate data in a reference file in the terminal unit; and based on a comparison of the transmitted supplemental location data relating to the information with supplemental location data in the reference file in the terminal unit; and storing the location coordinate data of the location in files of the information provider and in the terminal unit and sending the data from the information provider to the terminal unit as identification of a location to which transmitted information refers, the location coordinate data exactly designating the geographic coordinates of the location to every 10 to 500 m:

storage means for storing the program and for the reference file;

processor means for running the program;

reception means for receiving information from an information provider; and a readout device for reading out a report to a user of the terminal unit.

28. A terminal unit according to claim 27, further comprising a means of communication by which a correction of one of the reference file and a current reference file can be called, the channel being usable as a back channel.

29. A terminal unit according to claim 27, wherein the terminal unit is configured to be installable in a vehicle.

30. A terminal unit according to claim 27, wherein the readout device is an acoustic readout device operative to readout a report based on at least one of the information, location coordinate data and supplemental location data to the user of the terminal unit.

31. A terminal unit according to claim 27, wherein the readout device is an optical readout device.

32. A terminal unit according to claim 27, wherein the terminal unit includes a file that contains additional information for readout together with the information.

33. A terminal unit according to claim 27, and further comprising a map file with a traffic network map.

34. A terminal unit according to claim 33, and further comprising a position determining device for navigation.

35. A terminal unit according to claim 27, and further comprising reading means for reading in data from an exchangeable storage medium which can be introduced into the reading device.

36. A method for computer-aided generation of a reference file, a map file representing a traffic network and relating to locations of a predeterminable type, the method comprising the steps of:

one of calculating and reading out from the map file the locations;

one of determining and taking from the map file supplemental location data relating to a location; and determining the location coordinate data from geographic longitude and geographic latitude of the location with a predeterminable accuracy and filing the coordinate data together with the supplemental location data of the location in a target file.

37. A method according to claim 36, and further comprising the step of one of determining and taking from the map file attributes of a location and storing the attributes in the target file relating to the location:

storage means for storing the program and for the reference file;

processor means for running the program;

reception means for receiving information from an information provider; and a readout device for reading out a report to a user of the terminal unit.

38. A method according to claim 36, including storing the location coordinate data taken from the map file or determined on the basis of the map file in the target file with a predeterminable accuracy, in a form of geographic longitude and latitude coordinates required for displaying at an accuracy of 100 m.

39. A method according to claim 36, wherein locations of a predetermined type are at least one of road segments in the map file, road intersections, entrances and exits.

* * * * *